US009518569B2

(12) United States Patent
Howind et al.

(10) Patent No.: US 9,518,569 B2
(45) Date of Patent: Dec. 13, 2016

(54) ADJUSTMENT DEVICE FOR AN AXIAL PISTON MACHINE AND HYDRAULIC MACHINE HAVING SUCH AN ADJUSTMENT DEVICE

(71) Applicant: Robert Bosch GmbH, Stuttgart (DE)

(72) Inventors: Joern Howind, Tuebingen (DE); Carola Diebold, Eutingen (DE); Rolf Springmann, Sulz-Hopfau (DE)

(73) Assignee: Robert Bosch GmbH, Stuttgart (DE)

( * ) Notice: Subject to any disclaimer, the term of this patent is extended or adjusted under 35 U.S.C. 154(b) by 440 days.

(21) Appl. No.: 14/075,338

(22) Filed: Nov. 8, 2013

(65) Prior Publication Data

US 2014/0130661 A1 May 15, 2014

(30) Foreign Application Priority Data

Nov. 13, 2012 (DE) ..... 10 2012 022 201

(51) Int. Cl.

| | |
|---|---|
| ***F15B 15/22*** | (2006.01) |
| ***F04B 1/32*** | (2006.01) |
| ***F04B 1/20*** | (2006.01) |
| ***F04B 49/12*** | (2006.01) |

(52) U.S. Cl.

CPC ..... *F04B 1/324* (2013.01); *F04B 1/2078* (2013.01); *F04B 49/123* (2013.01)

(58) Field of Classification Search

CPC ..... F04B 1/324; F04B 1/2078
USPC ..... 92/13
See application file for complete search history.

(56) References Cited

U.S. PATENT DOCUMENTS

2003/0179004 A1* 9/2003 Fukusumi ..... G01R 31/343 324/713
2005/0172799 A1* 8/2005 Kadlicko ..... F01B 3/0035 92/71
2007/0199440 A1* 8/2007 Brockman ..... F15B 11/05 91/532

(Continued)

FOREIGN PATENT DOCUMENTS

DE 199 49 169 A1 4/2001

OTHER PUBLICATIONS

Rexroth Bosch Group; Axial Piston Variable Pump A10VO; Data Sheet RD 92703/08.11; Aug. 2011; 56 Pages; Bosch Rexroth AG, Horb a. N., Germany.

*Primary Examiner* — Thomas E Lazo
*Assistant Examiner* — Daniel Collins
(74) *Attorney, Agent, or Firm* — Maginot, Moore & Beck LLP

(57) ABSTRACT

An adjustment device for a pivoting cradle of a hydraulic machine, in particular of an axial piston machine, is disclosed. Said adjustment device has an actuating piston to which pressure medium for pivoting the pivoting cradle about a pivoting axis is applied via an actuating pressure space. In order to control the feeding in of pressure medium and the relieving of the actuating pressure space, a control valve is provided. Said control valve has a control piston configured to be adjusted by an electric actuator, wherein the electric actuator is controlled by a control device. In this context, the control device controls the electric actuator as a function of a control difference formed from a setpoint pivoting angle and an actual pivoting angle of the pivoting cradle. The actual pivoting angle of the pivoting cradle is fed back electrically to the control device here.

13 Claims, 3 Drawing Sheets

(56) References Cited

U.S. PATENT DOCUMENTS

2009/0197735 A1* 8/2009 Usukura ..... B62M 19/00
477/43
2009/0288552 A1* 11/2009 Beck ..... F04B 1/324
91/505

* cited by examiner

ADJUSTMENT DEVICE FOR AN AXIAL PISTON MACHINE AND HYDRAULIC MACHINE HAVING SUCH AN ADJUSTMENT DEVICE

This application claims priority under 35 U.S.C. §119 to patent application no. DE 10 2012 022 201.7, filed on Nov. 13, 2012 in Germany, the disclosure of which is incorporated herein by reference in its entirety.

BACKGROUND

The disclosure is based on an adjustment device according to the description below and on a hydraulic machine having such an adjustment device.

DE 199 49 169 C2 discloses such an adjustment device for adjusting a pivoting cradle of an axial piston machine. A pivoting angle of the pivoting cradle can be pivoted here by means of an actuating piston which acts on the pivoting cradle. In order to reduce the pivoting angle, pressure medium is fed to an actuating pressure space adjoining the actuating piston. In the direction of increasing the pivoting angle, a restoring spring (not shown in the document) acts on the pivoting cradle. In order to increase the pivoting angle, pressure medium is discharged from the actuating pressure space, with the result that the restoring spring can pivot back the pivoting cradle and shift the actuating piston. The actuating pressure which is present in the actuating pressure space is set in accordance with the force necessary to adjust and to hold the pivoting cradle. The inflow of pressure medium into the actuating pressure space and the outflow of pressure medium out of the actuating pressure space are controlled by a control valve. This is arranged coaxially with the actuating piston in a common recess together with the actuating piston. A control piston of the control valve can be shifted here in a first direction out of a control position in the direction of the actuating piston by means of a lifting magnet. During such shifting, a pressure medium connection between the actuating pressure space and a low pressure area of the axial piston machine is opened. In the opposing, second direction, that is to say in a direction away from the actuating piston, a spring force is applied to the control piston via a return spring which is supported on the actuating piston, which spring force converts the position of the actuating piston and therefore of the pivoting cradle into a force acting on the control piston, that is to say returns the position of the pivoting cradle as a force signal to the control piston. When the control piston shifts from the control position in the second direction, the control piston opens a pressure medium connection between the actuating pressure space and a high pressure side of the axial piston machine. In order to apply the spring force, the control piston projects out of the valve housing with its end section into the actuating pressure space, wherein a spring plate for the return spring is arranged on the end section. Through the return spring, the control piston has a mechanical operative connection to the actuating piston, which brings about a situation in which, by controlling the pressure medium connection between the actuating pressure space and the low pressure side or the high pressure side of the axial piston machine, the control piston sets a specific pivoting angle of the pivoting cradle as a function of a control force which is applied electromagnetically or hydraulically or in some other way to it counter to the force of the return spring.

In data sheet RD 92703/08.11 by the applicant, a further embodiment of an axial piston machine with a pivoting cradle is illustrated. In this context, a return spring is provided which is also supported on the actuating piston and which applies a spring force to the control piston via a spring plate. The spring plate is in turn supported on an end side of the control piston. An axial drilled hole of the control piston opens into the end side, which axial drilled hole is connected to a control connection of a further control valve pressure controller or pressure delivery current controller connection of the control valve and functions together with the return spring and the spring plate as a nonreturn valve if the other control valve outputs a signal to pivot the pivoting cradle, that is to say to reduce the pivoting angle.

A disadvantage with the embodiments explained above is that they are of complex configuration in terms of device technology.

In contrast, the disclosure is based on the object of providing an adjustment device and a hydraulic machine having such an adjustment device which are constructed in a simple way in terms of device technology.

SUMMARY

This object is achieved in terms of the adjustment device in accordance with the features described below and in terms of the hydraulic machine in accordance with the features described below.

Other advantageous developments of the disclosure are the subject matter of further description provided below.

According to the disclosure, an adjustment device for an adjustable pivoting cradle of a hydraulic machine, in particular of an axial piston machine, is provided. Said adjustment device has an actuating piston for pivoting the pivoting cradle about a pivoting axis. The actuating piston bounds an actuating pressure space via which pressure medium can be applied to the actuating piston. A feeding of pressure medium into the actuating pressure space and a relieving of pressure medium therefrom can be controlled by means of a control valve. For this purpose, a force can be applied in one direction to a control piston of the control valve by an electric actuator, in particular by a lifting magnet. An actual value of a controlled variable, in particular an actual pivoting angle of the pivoting cradle is fed back electrically to a control device in order to control the actuator.

This solution has the advantage that the actual pivoting angle of the pivoting cradle is no longer signaled to the control valve by means of a return spring between the actuating piston and the control piston, as in the prior art explained at the beginning, but instead this actual pivoting angle is fed back electrically. A return spring is no longer necessary in the adjustment device according to the disclosure, as a result of which said adjustment device is configured extremely simply in terms of device technology. Furthermore, it is possible to dispense with an axial drilled hole in the control piston, as is present in the adjustment device according to the data sheet RD 92703/08.11 explained at the beginning. In addition, an extremely high control quality can be achieved by means of the electrical control. It is no longer necessary for the actuating piston and control piston to be oriented flush with one another.

A pivoting angle sensor for detecting the actual pivoting angle of the pivoting cradle is advantageously provided. With the control device, which is, for example, a control unit of the RC series by the applicant, the actuator of the control valve can then be controlled as a function of the actual pivoting angle and a setpoint pivoting angle, as a result of which the pivoting angle can be set precisely.

The control piston of the control valve can be shifted in the direction of the first control positions by means of the electric actuator. In said control positions, a pressure medium connection between the actuating pressure space and a high pressure side of the axial piston machine can be controlled. The control piston can be shifted in the opposite direction by means of an opposing spring which is supported on a valve housing of the control valve. A pressure medium connection between the actuating pressure space and a low pressure side, in particular a leakage area, of the hydraulic machine can be controlled in said control piston.

It would be conceivable to actuate further adjustment devices of further hydraulic machines with the control device. The actuation can be carried out, for example via a CAN bus, a CANopen bus or a J1939 bus. It is conceivable here that the control device has the actual pivoting angle of the pivoting cradle signaled to it electrically by each actuated hydraulic machine, or an actual pivoting angle of a hydraulic machine is used to control all the hydraulic machines.

The control device preferably controls an actual control current as a manipulated variable for the actuator as a function of the setpoint pivoting angle and the actual pivoting angle. Another variable in the system can also be detected and controlled, for example the hydraulic pressure and/or the hydraulic volume flow. The hydraulic power can be determined and consequently controlled by means of the product of the pressure and the volume flow.

The control device preferably has a pivoting angle controller which is embodied, in particular, as a PID controller. The latter can form a setpoint control current as a function of a control difference formed from the setpoint pivoting angle and the actual pivoting angle.

The actual control current can preferably be controlled as a function of a control difference formed from the setpoint control current and the actual control current which can be fed back, using a current controller which is embodied, in particular, as a PID controller of the control device.

In a further refinement of the disclosure, the control piston can bound, with one end side, the actuating pressure space and be pressure-compensated with respect to the actuating pressure. The actuator is preferably a simple and compact lifting magnet. In addition, a restoring spring is provided which can be supported on a machine housing of the axial piston machine, wherein the return spring acts counter to a force applied to the pivoting cradle by the actuating piston, and in the stationary state of the axial piston machine said return spring moves the pivoting cradle to the maximum pivoting angle.

According to the disclosure, a hydraulic machine, in particular an axial piston machine (axial piston pump or axial piston motor) is provided which has a pivoting cradle. The latter can be pivoted with the adjustment device according to the disclosure.

Such a hydraulic machine is advantageously of extremely simple configuration in terms of device technology. In addition, the hydraulic machine according to the disclosure can be manufactured by simply omitting the control spring and the piston drilled hole, opening into the end side of the control piston, in the hydraulic machines explained at the beginning. All that is necessary is to provide a pivoting angle sensor which is electrically connected to the control device. Conventional hydraulic machines can therefore easily be retrofitted to form the hydraulic machine according to the disclosure.

BRIEF DESCRIPTION OF THE DRAWINGS

In the text which follows, the disclosure will be explained in more detail with reference to an exemplary embodiment illustrated in the drawings, in which.

DETAILED DESCRIPTION

Figure 1:
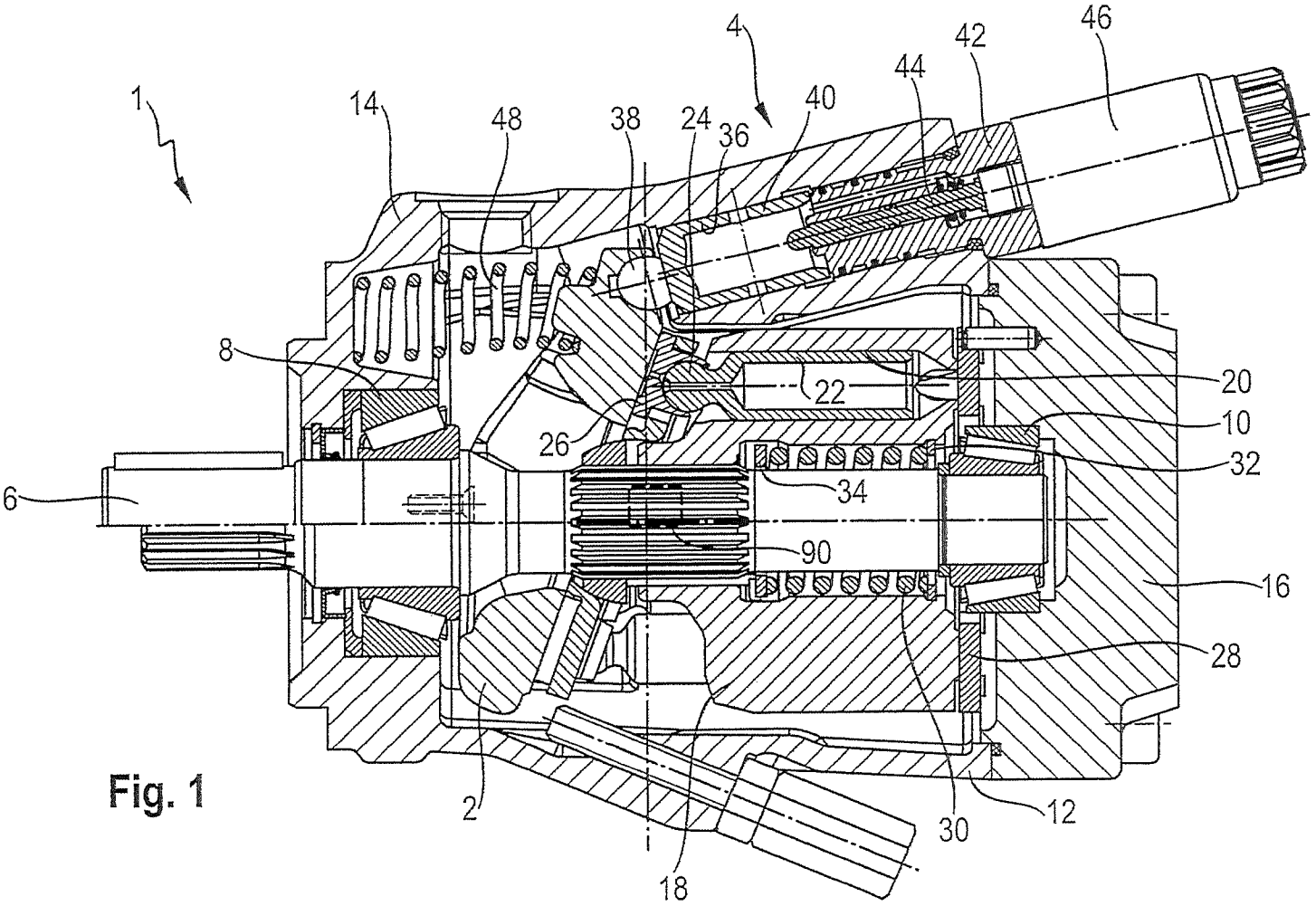
FIG. 1 shows a longitudinal section through a hydraulic machine according to the disclosure with an adjustment device according to the disclosure in accordance with one embodiment.

According to FIG. 1, the hydraulic machine is represented in the form of an axial piston machine 1, in particular an axial piston pump, having a pivoting cradle 2 which can be pivoted about a pivoting axis and which can be pivoted with an adjustment device 4 according to the disclosure. Said adjustment device 4 serves to perform electro-proportional volume flow adjustment (EP adjustment) of the axial piston machine 1. A basic configuration of the axial piston machine 1 is known sufficiently from the prior art, for which reason only features which are essential for the disclosure will be explained below.

A driveshaft 6 of the axial piston machine 1 is mounted in a rotatable fashion by means of a first and a second roller bearing 8 and 10 in a machine housing 12 of the axial piston machine 1. The machine housing 12 has a pot-shaped housing section 14 which is closed off by a housing lid 16.

A cylinder drum 18 is connected in a rotationally fixed fashion to the shaft 6. Cylinder drilled holes 20 are embodied offset on a pitch circle in the cylinder drum 18. A piston 22 is arranged in an axially displaceable fashion in each of said cylinder drilled holes 20. A respective piston 22 is connected to a sliding shoe 26 via a ball-and-socket joint connection 24 and is supported on the pivoting cradle 2 via said sliding shoe 26. The cylinder drilled holes 20 are connected to a high pressure side (not illustrated) of the axial piston machine 1 and to a low pressure side (not illustrated either) via a control plate 28 in which kidney-shaped openings are formed. A stroke of the piston 22 in the cylinder drilled holes 20 is predefined by a pivoting angle of the pivoting cradle 2. According to FIG. 1, the pivoting cradle is shown in its state in which it can be pivoted to a maximum extent and in which a maximum delivery volume is set.

The cylinder drum 18 is held in abutment against the control plate 28 by means of a spring 30. For this purpose, the spring 30 is supported via a first ring 32 on the cylinder drum 18 and via a second ring 34 on the driveshaft 6. The cylinder drum 18 can be moved axially with respect to the fixed driveshaft 6 via a wedge/groove connection or toothing arrangement.

In order to pivot the pivoting cradle 2, the adjustment device 4 according to the disclosure is provided. Said adjustment device 4 is held in a receptacle drilled hole 36, formed to the side of the cylinder drum 18, in the housing section 14 of the machine housing 12. The adjustment device 4 has an actuating piston 40, connected via a ball-and-socket joint connection 38 to the pivoting cradle 2 and guided axially in the receptacle drilled hole 36. Axially to the actuating piston, a control valve 42 is inserted into the receptacle drilled hole 36 coaxially with respect to said actuating piston. Said control valve 42 has a control piston 44 which can be actuated by means of an electric actuator in the form of a lifting magnet 46.

Counter to an actuating force of the actuating piston 40, a return force of a restoring spring 48 is applied to the pivoting cradle 2, which restoring spring 48 is supported on the machine housing 12. Said return force acts on the pivoting cradle 2 on the side of the pivoting cradle which points away from the actuating piston 40 and is located approximately opposite the ball-and-socket joint connection 38.

Figure 2:
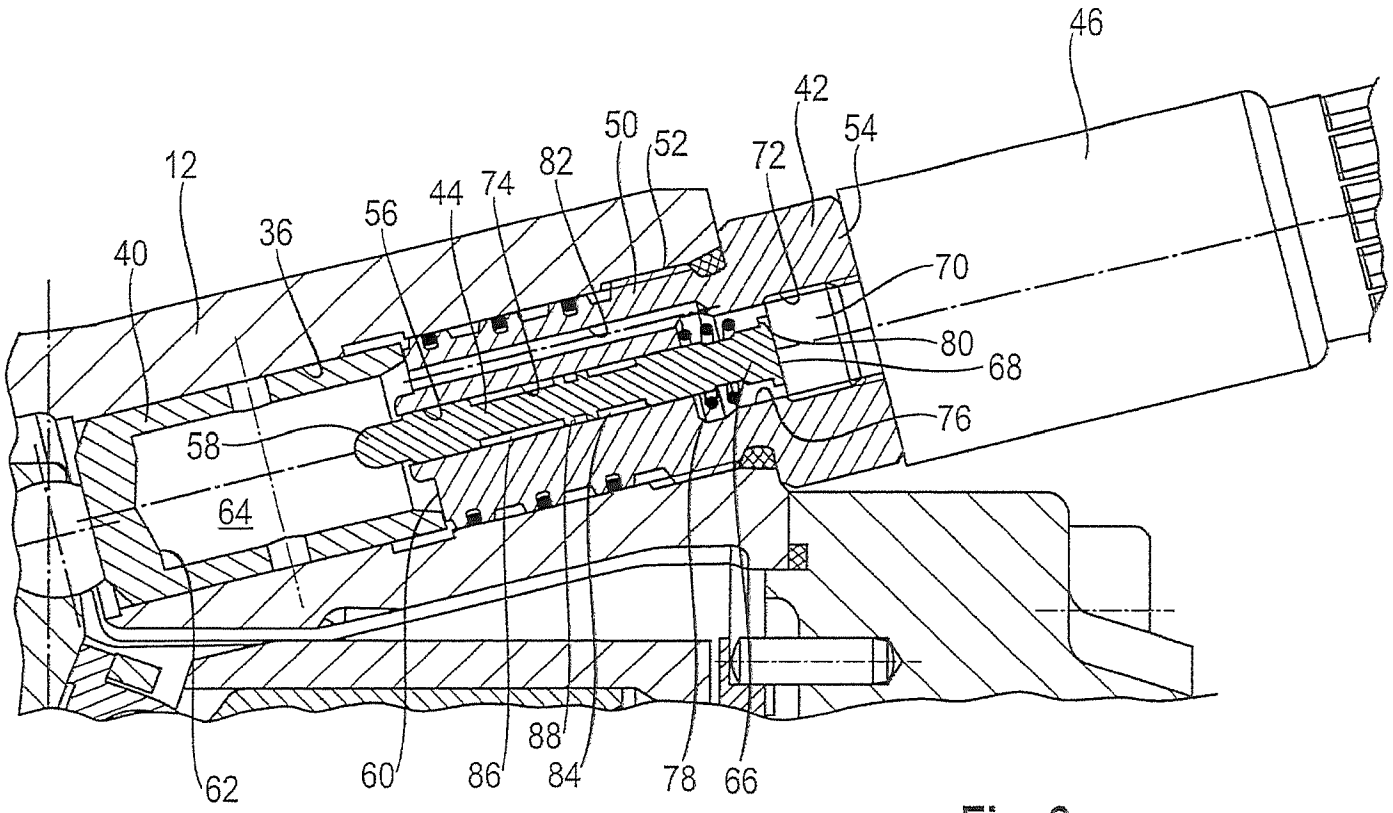
FIG. 2 shows an enlarged detail of the hydraulic machine from FIG. 1 in the region of the adjustment device.

According to FIG. 2, the control valve 42 has a valve housing 50 which is embodied as a valve sleeve. Said valve housing 50 is screwed into an internal thread 52 of the receptacle drilled hole 36. The screw-in depth of the valve housing 50 is bounded by a radially widened housing section 54 which bears, in the screwed-in state with its annular end face pointing to the actuating piston 40 on the machine housing 12. The piston drilled hole 56 is provided in the valve housing 50 and completely penetrates the latter. The control piston 44 is guided in a sliding fashion in the piston drilled hole 56. Said control piston 44 has an end section 58 which protrudes out of the valve housing 50 toward the actuating piston 40. An end side 60 of the valve housing 50, from which end side 60 the end section 58 of the control piston 44 projects, bounds an actuating pressure space 64, together with the control piston 44 and a piston side 62, facing the valve housing 50, of the actuating piston 40 and the receptacle drilled hole 36. Pressure medium can be applied to the actuating piston 40 via said actuating pressure space 64. In the exemplary embodiment, a control piston which is conventional in terms of the dimensions is used, said control piston protruding over the valve housing 50. The control piston could also be much shorter than the conventional control piston, with the result that the complex fabrication of the spherical end section is dispensed with.

An approximately planar end side 68, which points toward the lifting magnet 46 and extends in the radial direction with respect to the longitudinal axis of the control piston 44, is formed on the other end section 66 of the control piston 44. An armature plunger (not illustrated) of the lifting magnet 46 acts on said end side 68 in order to shift the control piston 44 in the direction of the actuating piston 40 using a magnetic force. The lifting magnet 46 is screwed with a pole tube 70 into a threaded section 72 of the piston drilled hole 56. A screw-in depth of the lifting magnet 46 is limited by virtue of the fact that a housing side, pointing to the valve housing 42, of the lifting magnet 46 bears approximately on the end side, pointing to the lifting magnet 46, of the valve housing 50.

The control piston 44 is guided in a sliding fashion in a guide section 74 of the piston drilled hole 56, said guide section 74 extending from the end side 60 of the valve housing 50 in the direction of the lifting magnet 46. Subsequent to the guide section 74, the piston drilled hole 56 has a radially extended step 76 which is adjoined by the threaded section 72. The step 76 and the threaded section 72 have approximately the same internal diameter. An opposing spring 78, which is supported on the valve housing 50 and applies a spring force to the control piston 44 via a radial collar 80 counter to the magnetic force or in the direction away from the actuating piston 40, is arranged in the region of the step 76 in the valve housing 50.

At a parallel distance from the piston drilled hole 56, a blind drilled hole 82 is formed in the valve housing 50 and extends from the end side 60 and opens into the piston drilled hole 56 in the region of the step 76, as a result of which the control piston 44 is pressure-compensated at the end side.

The control piston 44 has a first annular groove 84 and a second annular groove 86 arranged in series, said annular grooves 84 and 86 bounding in each case an annular space together with the piston drilled hole 56 in the region of the guide section 74. A radial collar 88 is formed by the annular grooves 84 and 86, between the latter on the control piston 44. The annular space which is arranged closer to the lifting magnet 46 in FIG. 2 and bounded by the annular groove 84 is connected to a tank duct (not illustrated) which is formed in the valve housing 50 and can be connected in turn to a tank or a low pressure side of the axial piston machine 1. The other annular space, bounded by the annular groove 86, is connected to a delivery pressure duct (not illustrated) which is formed in the valve housing 50 and can be connected in turn to a high pressure side of the adjustment pump. Furthermore, an actuating pressure duct (not illustrated) is formed radially with respect to the piston drilled hole 56 in the valve housing 50 and completely penetrates the latter. Two longitudinal drilled holes (not illustrated) open into the latter and extend from the end side 60 of the valve housing 50 at a parallel distance from the piston drilled hole 56 and connect the actuating pressure space 64 to the actuating pressure duct (not illustrated). The control piston 44 can be shifted axially by means of the armature plunger (not illustrated) of the lifting magnet 46, in an adjustment direction in which said control piston 44 is shifted away from the lifting magnet 46. In this adjustment direction, the control piston 44 controls a pressure medium connection between the annular space bounded by the annular groove 84 and connected to the tank duct (not illustrated) and the actuating pressure duct (not illustrated) via its radial collar 88. In the opposite adjustment direction, that is to say when the control piston 44 is shifted toward the lifting magnet 46, the latter controls a pressure medium connection between the annular space bounded by the annular groove 86 and connected to the delivery pressure duct (not illustrated) and the actuating pressure duct (not illustrated), via its radial collar 88.

In order to electrically feed back an actual pivoting angle of the pivoting cradle 2 from FIG. 1 to a control device in order to control the adjustment device 4, a pivoting angle sensor 90 is provided. The latter is indicated in highly simplified form by a dashed line in FIG. 1. The pivoting angle sensor 90 is defined here in the machine housing 12 in the region of a pivoting axis of the pivoting cradle 2 and measures the actual pivoting angle in a contactless fashion. For this purpose, a magnet is provided in the region of the pivoting axis on the pivoting cradle 2, which magnet interacts with the pivoting angle sensor 90, which is embodied as a Hall sensor. The actual pivoting angle which is detected is signaled to a control device of the adjustment device 4 via a signal line (not illustrated), said adjustment device 4 being illustrated in FIG. 3 as a block circuit diagram and being provided with the reference number 92.

Figure 3:
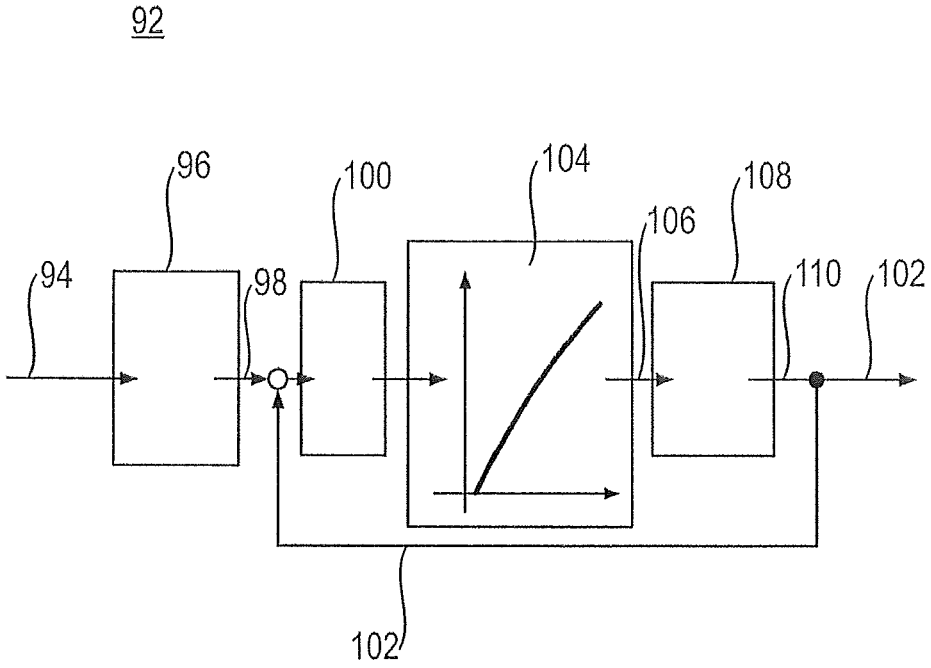
FIG. 3 shows a block circuit diagram of a control device of the adjustment device according to the disclosure.

According to FIG. 3, the control device 92 has a setpoint pivoting angle 94 as a reference variable. This is a voltage which is, for example, between 0 and 5 volts. This voltage is scaled to internal values by the control device 92, which is shown by the block 96. The scaling is done here, for example, in such a way that 2.5 volts corresponds to a pivoting angle of 0%, 0 volts to a pivoting angle of −100% and 5 volts to a pivoting angle of 100%. The internal value of the scaled setpoint pivoting angle 98 is signaled to a pivoting angle controller 100 which is a controller with P, I and D components as parameters. In addition to the setpoint pivoting angle 98, the actual pivoting angle 102 is fed to the pivoting angle controller 100. A voltage which is assigned to a setpoint control current via a pivoting angle control current characteristic diagram 104 is determined by the pivoting angle controller 100 as a function of a control difference formed from a setpoint pivoting angle and an actual pivoting angle. The setpoint control current 106 is fed to a current controller 108 which has a P component and I component, a dither frequency and a coil resistance as parameters and controls an actual control current 110 as a function of a control difference formed from the setpoint control current 106 and the actual control current 110. The current controller 108 then actuates the lifting magnet 46 from FIG. 1 with the actual control current 110, which lifting magnet 46 forms the controlled system. This then results in the actual pivoting angle 102 as a controlled variable, which is fed back to the pivoting angle controller 100.

A spring force is applied to the control piston 44 via the adjustment device 4 according to the disclosure via the opposing spring 78 exclusively. In the prior art, as, for example, in DE 199 49 169 C2 explained at the beginning, a return spring, supported on the actuating piston, is additionally applied to the control piston. Since only the opposing spring 78 acts with a spring force counter to the magnetic force of the lifting magnet 46, said opposing spring 78 is made comparatively strong and with a length such that the control piston can be pressed into an end position by said spring.

An adjustment device for a pivoting cradle of a hydraulic machine, in particular of an axial piston machine, is disclosed (Farrad). Said pivoting cradle has an actuating piston to which pressure medium for pivoting the pivoting cradle about a pivoting axis can be applied via an actuating pressure space. A control valve is provided for controlling the feeding of pressure medium into the actuating pressure space and the relieving thereof. Said control valve has a control piston which can be adjusted by means of an electric actuator, wherein the electric actuator is controlled by means of a control device. The control device controls in this context the electric actuator as a function of a control difference formed from a setpoint pivoting angle and an actual pivoting angle of the pivoting cradle. The actual pivoting angle of the pivoting cradle is fed back electrically to the control device here. Alternatively, the hydraulic pressure, the hydraulic volume flow or the hydraulic power can be detected as controlled variables and fed back.

LIST OF REFERENCE NUMBERS

1 Axial piston machine
2 Pivoting cradle
4 Adjustment device
6 Driveshaft
8 Roller bearing
10 Roller bearing
12 Machine housing
14 Housing section
16 Housing lid
18 Cylinder drum
20 Cylinder drilled hole
22 Piston
24 Ball-and-socket joint connection
26 Sliding shoe
28 Control plate
30 Spring
32 Ring
34 Ring
36 Receptacle drilled hole
38 Ball-and-socket joint connection
40 Actuating piston
42 Control valve
44 Control piston
46 Lifting magnet
48 Restoring spring
50 Valve housing
52 Internal thread
54 Housing section
56 Piston drilled hole
58 End section
60 End side
62 Piston side
64 Actuating pressure space
66 End section
68 End side
70 Pole tube
72 Threaded section
74 Guide section
76 Step
78 Opposing spring
80 Radial collar
82 Blind drilled hole
84 Annular groove
86 Annular groove
88 Radial collar
90 Pivoting angle sensor
92 Control device
94 Setpoint pivoting angle
96 Block
98 Setpoint pivoting angle
100 Pivoting angle controller
102 Actual pivoting angle
104 Characteristic diagram
106 Setpoint current
108 Current controller
110 Actual current

What is claimed is:

1. An adjustment device for an adjustable pivoting cradle of a hydraulic machine, the adjustment device comprising:

an actuating piston to which pressure medium is applied via an actuating pressure space to pivot the pivoting cradle about a pivoting axis; and a control valve configured to control a feeding of the pressure medium to the actuating pressure space and a relieving of the pressure medium from the actuating pressure space, the control valve having a control piston configured to be controlled by an electric actuator, wherein an actual value of a controlled variable is fed back electrically to a control device to control the electric actuator, and wherein the control piston and the actuating piston are mechanically decoupled, such that the control piston is independently movable relative to the actuating piston by the electric actuator.

2. The adjustment device according to claim 1, further comprising a pivoting angle sensor configured to detect an actual pivoting angle of the pivoting cradle.

3. The adjustment device according to claim 2, wherein the pivoting angle sensor is a Hall sensor.

4. The adjustment device according to claim 1, wherein:

the control piston is configured to be shifted by the electric actuator in a direction of first control positions in which a pressure medium connection between the actuating pressure space and a high pressure side of the axial piston machine can be controlled, and the control piston is configured to be shifted, by an opposing spring supported on a valve housing of the control valve, in a direction of second control positions in which a pressure medium connection between the actuating pressure space and a low pressure side of the axial piston machine can be controlled.

5. The adjustment device according to claim 1, wherein the control device is configured to control further adjustment devices of further hydraulic machines.

6. The adjustment device according to claim 1, wherein the control device is configured to determine an actual control current as a manipulated variable for the actuator as a function of a setpoint pivoting angle and of an actual pivoting angle.

7. The adjustment device according to claim 6, wherein the control device is configured to form a setpoint control current with a controller as a function of a control difference formed from a setpoint value and the actual value of the variable to be controlled.

8. The adjustment device according to claim 7, wherein the control device is configured to control an actual control current with a current controller as a function of a control difference formed from a setpoint control current and the actual control current.

9. A hydraulic machine, comprising:

a pivoting cradle; and an adjustment device for the pivoting cradle, the adjustment device including:

an actuating piston to which pressure medium is applied via an actuating pressure space to pivot the pivoting cradle about a pivoting axis; and a control valve configured to control a feeding of the pressure medium to the actuating pressure space and a relieving of the pressure medium from the actuating pressure space, the control valve having a control piston configured to be controlled by an electric actuator, wherein an actual value of a controlled variable is fed back electrically to a control device to control the electric actuator, and wherein the control piston and the actuating piston are mechanically decoupled, such that the control piston is independently movable relative to the actuating piston by the electric actuator.

10. The adjustment device according to claim 1, wherein the actual value of the controlled variable is an actual pivoting angle of the pivoting cradle.

11. The adjustment device according to claim 7, wherein the controller is a pivoting angle controller.

12. The adjustment device according to claim 11, wherein the pivoting angle controller is a PID controller.

13. The adjustment device according to claim 8, wherein the current controller is a PID controller.

* * * * *